United States Patent [19]

Wilfong, Jr.

[11] Patent Number: 4,981,216

[45] Date of Patent: Jan. 1, 1991

[54] EASY OPENING BAG PACK AND SUPPORTING RACK SYSTEM AND FABRICATING METHOD

[75] Inventor: Harry B. Wilfong, Jr., Hartsville, S.C.

[73] Assignee: Sonoco Products Co., Hartsville, S.C.

[21] Appl. No.: 472,781

[22] Filed: Jan. 31, 1990

[51] Int. Cl.[5] ..... B65D 30/10; B65D 33/10; B65D 33/14

[52] U.S. Cl. ..... 206/554; 383/8; 383/9; 383/37; 248/97; 248/100; 493/204

[58] Field of Search ..... 206/554; 383/8, 9, 37; 248/97, 100

[56] References Cited

U.S. PATENT DOCUMENTS

| | | | |
|---|---|---|---|
| 4,480,750 | 11/1984 | Dancy | 383/8 X |
| 4,487,388 | 12/1984 | Provan | 248/99 X |
| 4,529,090 | 7/1985 | Pilon | 383/8 X |
| 4,676,378 | 6/1987 | Baxley et al. | 383/8 X |
| 4,759,639 | 7/1988 | DeMatteis | 383/9 X |
| 4,781,474 | 11/1988 | Sengewald | 206/554 |
| 4,785,938 | 11/1988 | Benoit, Jr. et al. | 383/8 X |
| 4,796,759 | 1/1989 | Schisler | 206/554 |
| 4,811,417 | 3/1989 | Prince et al. | 383/8 X |
| 4,821,985 | 4/1989 | DeMatteis et al. | 248/97 |
| 4,840,336 | 6/1989 | Stroh et al. | 248/97 |
| 4,869,447 | 9/1989 | Malik | 248/97 |
| 4,883,450 | 11/1989 | Benoit | 383/9 X |

FOREIGN PATENT DOCUMENTS

| | | | |
|---|---|---|---|
| 79465 | 1/1982 | Australia | 206/554 |
| 2002732 | 8/1970 | Fed. Rep. of Germany | 248/100 |
| 2803961 | 8/1978 | Fed. Rep. of Germany | 206/554 |
| 2751195 | 5/1979 | Fed. Rep. of Germany | 206/554 |
| 34640 | 10/1965 | Finland | 248/100 |
| 1455621 | 9/1966 | France | 206/554 |
| 2427982 | 2/1980 | France | 206/554 |
| 155589 | 8/1956 | Sweden | 248/100 |

*Primary Examiner*—William I. Price

*Attorney, Agent, or Firm*—Bell, Seltzer, Park & Gibson

[57] ABSTRACT

An easy opening bag pack and supporting rack system is provided which includes a plurality of gussetted bags of the T-shirt type or of the flat top type provided with bag mounting apertures through all of the bag walls on opposed sides thereof and additional cuts in the front wall portion and the front section of the gussetted side wall portions and in communication with the bag mounting apertures therein for effectively enlarging such apertures. A rack mounts the bag pack through the mounting apertures and includes stub shaft supports laterally spaced from each other and being of a length less than the outwardly extending dimensions of an open bag and greater than the thickness of the bag pack and include an enlarged portion on the free outer ends thereof of greater dimensions than the bag mounting apertures. With this construction, the front wall and the front section of the gussetted side walls may be easily pulled from the stub shaft supports to open the outermost bag in the pack while retaining the rear wall and the rear section of the gussetted side wall of the bag on the stub shaft supports so that the bag is partially held on the rack in the opened position during loading. A method of fabricating the bags is also provided which forms the additional cut to enlarge the bag mounting apertures in the front wall and front section of the gussetted side walls by cutting against flat plates positioned within the gusset folds of a continuous tube of film being utilized to fabricate the bags.

19 Claims, 6 Drawing Sheets

EASY OPENING BAG PACK AND SUPPORTING RACK SYSTEM AND FABRICATING METHOD

FIELD OF THE INVENTION

This invention relates to a bag pack and supporting rack system, particularly of the thermoplastic type for grocery or retail products, providing for easy opening of consecutive bags from the pack and supporting of the opened bag on the rack during loading of the bag for ultimate removal of a loaded bag, and a method for fabricating such bag pack.

BACKGROUND OF THE INVENTION

Plastic bags have been replacing paper bags in the United States since the 1970s for the grocery and retail products industries due to the superior and inherent moisture resistant properties of plastic. For these industries, these plastic bags usually include integrally connected front and rear wall portions and gussetted side wall portions secured together at the bottoms thereof to define a closed bottom on the bag and at least the front and rear wall portions are open at the top to define a mouth portion on the bag. A majority of these bags have been of the T-shirt type which provide spaced integral handles laterally extending from opposed sides of the open mouth and the top of the bag to provide ease in carrying of the bag by the consumer. However, these plastic bags have also included generally flat top rectangular shaped bags, similar to the prior paper bags without upwardly extending handles, and which may include a handle opening cut through the bag walls in an intermediate portion thereof near the top so that a consumer can grasp and carry the bags through the handle opening. These bags have generally been provided to and used by the grocery and retail product industries in the form of packs of a plurality of such bags and have been mounted on racks for consecutive detachment of the bags from the pack and for holding the bags in an open position for loading before removal from the rack.

One of the major problems encountered with these plastic bag pack and rack systems has been the development of such a system that will adequately and efficiently provide a means for dispensing and loading bags made of ultra-thin plastic material that in many cases are very difficult and cumbersome to work with because of their flexible nature. These problems are compounded in cases where the person filling the bag with grocery or retail products is not trained or familiar with the particular bag/rack system. This was particularly true where the bag/rack system required removal of consecutive bags from a pack mounted on a rack by a central mounting tab and stretching the handles of the removed bag over tabs on arm portions of a rack, such as disclosed in U.S. Pat. No. 4,487,388 assigned to Mobil Oil Corporation.

A major breakthrough with this problem came with the development of the QUIKMATE® bag/rack system which mounted a pack of thermoplastic grocery bags of the T-shirt type on a rack by a central mounting tab and by apertures in the handles of the bags and which supported consecutive bags frcm the pack on supporting rods or arms on the rack in an open loading position by the apertures in the handles cf the bag on the supporting rods of the rack and for facilitating easy removal of the consecutive loaded bags from the rack, as disclosed in U.S. Pat. No. 4,676,378 assigned to Sonoco Products Company (the assignee of the present application). This QUIKMATE® bag/rack system allowed consecutive bags to be opened by breaking the central mounting tab on the front wall portion of the bag and pulling the front wall portion of the bag open by sliding the handles having apertures therein along the outwardly extending support rods of the rack for loading of the bags. This QUIKMATE® system has been very successful in most applications once the user has practiced using the QUIKMATE® bag/rack system. This system has replaced most of the prior bags/-rack systems in the grocery and retail products industries.

However, there are still certain problems with the ease of manual opening of consecutive bags not only with the QUIKMATE® bag/rack system but also with other bag/rack systems. In that regard, there is a natural tendency for the walls of the flat bags of thermoplastic material to cling together and be difficult to separate, particularly when the bags and bag packs are mounted on a rack and suspended therefrom by central mounting tabs and handle apertures. Others have recognized this problem of manually opening the consecutive bags to overcome the natural tendency of the thermoplastic bag walls to cling to each other by providing so called "front-side-free" or partially "front-side-free" bag constructions, such as disclosed in U.S. Pat Nos. 4,785,938 to Mobil Oil Corporation and 4,796,759 to C.E.E. Compagnie Europeene des Emballages, and published Australian Patent Application No. 79465 of Union Carbide Australia Limited.

These so called "front-side-free" bag constructions were directed to central mounting tabs which were cut free or eliminated entirely on the front panel of the bag; however, these bag constructions still exhibited problems with ease of manually opening of the bags and overcoming the natural tendency of the thermoplastic bag walls to cling together. Accordingly, these so called "front-side-free" bag constructions have not met with any substantial commercial acceptance at this point in time. Moreover, fabrication of these bags is difficult, as may be seen by reference to the aforesaid Australian Patent Application No. 79465 inasmuch as the fabrication process described therein requires the use of a "mouse" inside the tube of thermoplastic film being utilized to fabricate the bag. The term "mouse" in the context of plastic bag manufacturing refers to a device that is free to move inside the tube of film and is trapped in a particular location by the use of rolls or guides and is used generally as an anvil in a cutting operation. This process is complicated and troublesome to run in production and is generally viewed in the industry as not being a viable method for efficient, high speed production of thermoplastic grocery or retail product bag packs, particularly when utilizing ultra-thin gauge materials that are becoming the industry standard.

OBJECTS AND SUMMARY OF THE INVENTION

Accordingly, it is the object of this invention to provide an easy opening bag pack and supporting rack system and method of fabricating such easy opening bag packs which overcome the above problems heretofore experienced in the industry.

It has been found by this invention that such object may be accomplished by providing an easy opening bag pack and/or supporting rack system including generally the following generic features.

A bag pack is provided which includes a plurality of stacked bags. Each of such bags comprises integrally connected front and rear wall portions and gussetted side wall portions. All of the wall portions are secured together at the bottoms thereof to define a closed bottom on the bag. At least the front and rear wall portions are open at the tops thereof to define a mouth portion on the bag. Aligned bag mounting apertures are cut through all of the wall portions on opposed sides of the bag near the top thereof and additional cuts are provided for effectively enlarging the apertures in the front wall portion and the front section of the gussetted side wall portions. Each of the bags may include laterally spaced handles integral with the wall portions and extending upwardly from opposed sides of the mouth portion and which have the aligned bag mounting apertures formed through an intermediate area of the handles. Alternatively, each of the bags may have a generally flat top portion without upwardly extending handles and may include aligned generally U-shaped cuts through a central area of the front and rear wall portions below the mouth portion to form handle openings in the bag.

A rack is provided for mounting the bag pack in a generally vertically suspended position. The rack includes two outwardly extending stub shaft supports laterally spaced from each other and having free outer end portions. The stub shaft supports are of a length less than the outwardly extending dimensions of a bag open for loading and greater than the thickness of the bag pack for slidably receiving the bag mounting apertures and mounting the bag pack on the rack. The stub shaft supports have an enlarged portion on the free outer ends of greater dimensions than the bag mounting apertures.

With the above construction of a bag pack and supporting rack system, the front wall portions and the front sections of the gussetted side wall portions having the additional cuts for effectively enlarging the apertures therein may be easily pulled from the stub shaft support means to open the outermost bag in the bag pack while retaining the rear wall and the rear section of the gussetted side wall portions of the bag on the stub shaft supports by virtue of the resistance provided against the apertures therein by the enlarged portion on the free ends of the supports so that the opened bag is partially held on the rack in the open position during loading.

Each of the bags in the bag pack may further includes detachable mounting tabs extending from at least the front and rear wall portions in the vicinity of the mouth portion and which include a mounting aperture therein and are detachably connected to the respective wall portions for easy detachment by tearing of the respective wall portions from the mounting tabs. The rack may further includes a bag mounting tab retaining device positioned generally between the stub shaft supports (1) for receiving and mounting the apertures in the bag mounting tabs, (2) for cooperating with the stub shaft supports to mount the bag pack on the rack and to support the consecutive opened bags on the rack and (3) for allowing consecutive detachment of the front and rear wall portions of each of the bags from the mounting tabs as the bags are opened and then removed from the rack by retaining the bag mounting tabs on the retaining device.

The easy opening bag packs may be fabricated by a method including the following steps. A generally flat side-gussetted continuous tube, preferably of thermoplastic material, is fed in a generally linear direction and along flat plates extending into the side gusset folds to separate front and rear sections of the gusset folds. The top layer and front section of the gussetted folds are cut against the flat plates on opposed sides of the continuous flat tube in a desired configuration at spaced intervals as the tube is being fed in the linear direction to form the additional cut portions for effectively enlarging the bag mounting apertures in the bags being fabricated. Thereafter, the continuous flat tube is transversely cut at spaced intervals as the tube is being fed in the linear direction and between the cuts formed by the preceding cutting step to form individual bags from the tube having closed ends forming the tops and bottoms of the bags. Bag mounting apertures are cut through all of the layers on opposed sides of the bags and in communication with the additional cut in the top layer and front section of the gussetted folds at a desired time in the bag fabricating method.

In the case of bag packs in which the bags have upwardly extending laterally spaced handles, the step of transversely cutting the continuous flat tube preferably also includes sealing to form individual bags from the tube having closed ends forming the tops and bottoms of the bags. Thereafter, the individual bags are stacked and a desired portion is cut from the tops of the stacked bags to form the open mouth and handles to produce the desired T-shirt configuration at the tops of the bags, while the bag mounting apertures are cut through all of the layers in the handles and in communication with the additional cut previously formed in the top layer and front section of the gusset folds in the handles.

With the above construction of an easy opening bag pack and/or supporting rack and the method of fabricating such bag packs, the problems encountered with prior products and methods of this type have been overcome. Additionally, the present invention has provided a bag pack and rack system in which secure attachment of the rear panel of each of the bags in the bag pack to the rack is obtained independent of the front panel of the bag, and easy opening of each of the bags for loading is obtained through a substantially or completely "front-side-free" construction. A more user friendly and ergonomically sound bag pack and supporting rack system is provided because of the elimination of long outwardly extending supporting arms in the rack which were heretofore utilized and which hinder access to the bag and cause more lifting and shoulder strain to package items in an open bag. Space saving is provided at the front end of the system by elimination of the heretofore utilized long protruding support arms on the bag rack. A viable method of fabricating such bags has been provided which eliminates the use of a movable "mouse" and provides an easy method of fabricating the additional cut in the front wall portions of the gussetted bag. Lastly, a bag pack and rack system is provided wherein a bag may be easily opened and held in the open position by retaining only the rear section of the gussetted portion and the rear wall of the bag on the rack and allowing the front wall portion and the front wall section of the gussetted wall portion to hang in an open position off of the rack.

BRIEF DESCRIPTION OF THE DRAWINGS

Some of the objects and advantages of the invention having been set forth, other objects and advantages will appear from the detail descriptions of preferred embodiments of the invention when taken in conjunction with the accompanying drawings, in which.

DETAILED DESCRIPTION OF PREFERRED EMBODIMENTS OF THE INVENTION

Figures 22, 23, 24:
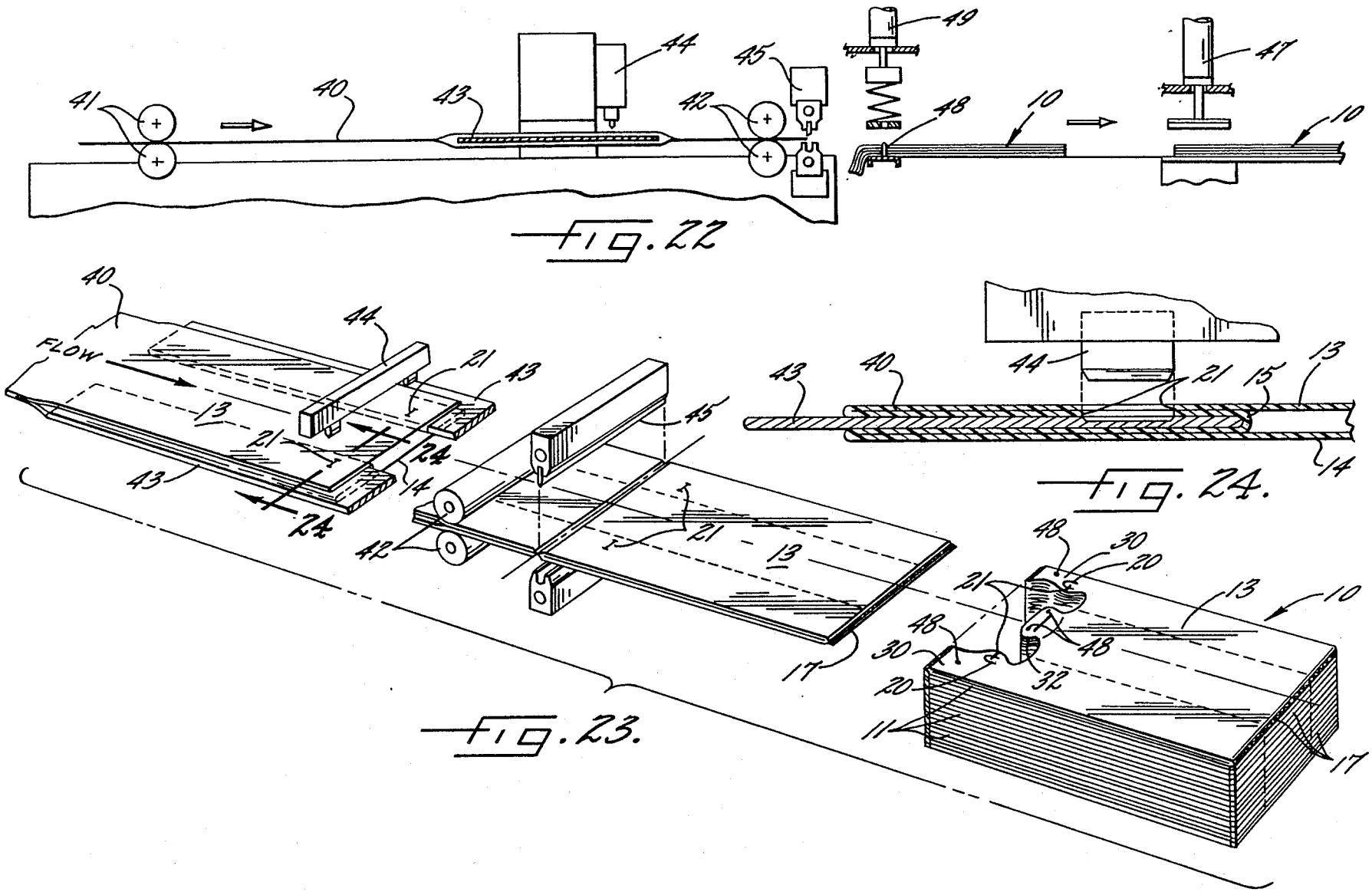
FIG. 22 is a schematic side sectional view illustrating a method of fabricating bag packs in accordance with this invention.
FIG. 23 is a schematic perspective view illustrating some of the method steps of FIG. 22.
FIG. 24 is an enlarged side sectional view illustrating one of the steps of the method of FIG. 22.

Referring now to the drawings, there is illustrated in FIGS. 1–8 a first embodiment of a preferred easy opening bag pack and supporting rack system in accordance with the present invention. FIGS. 9–10, 11–12, 13–17, and 18–21 illustrate respective second, third, fourth, and fifth preferred embodiments of an easy opening bag pack and supporting rack system constructed in accordance with the present invention. It is to be understood that features of these five preferred embodiments of the bag pack and supporting rack system could be utilized interchangeably with other embodiments. FIGS. 22–24 illustrate the steps utilized in a preferred method of fabricating easy opening grocery or retail product bag packs in accordance with the present invention.

In the description to follow of all of the preferred embodiments of the bag pack and supporting rack system of the present invention, like reference characters will be utilized in all of these embodiments and Figures for like structural features.

In all of the embodiments of the easy opening bag pack and supporting rack system, in accordance with this invention, the bag pack, indicated generally by the reference character 10, includes the following. A plurality of stacked bags 11 is provided in which each of the bags comprises integrally connected front and rear wall portions 13, 14 and gussetted side wall portions 15. All of the wall portions 13, 14, 15 are secured together at 17 at the bottoms thereof by heat sealing or the like to define a closed bottom on the bag. At least a part of the front and rear bag wall portions 13, 14 are open at the tops thereof to define a mouth portion 18 in the bags 11. Aligned bag mounting apertures 20 are cut through all of the wall portions 13, 14, 15 on opposed sides of the bag 11 near the top thereof. Additional cuts 21 are provided in the front wall 13 and the front section of the gussetted side wall 15 and in communication with the apertures 20 therein for effectively enlarging the apertures 20 in the front wall 13 and the front section of the gussetted side walls 15.

All of the embodiments of the easy opening bag pack and supporting rack system also include a rack 25 for mounting the bag pack 10 in a generally vertically suspended position. The rack 25 includes two outwardly extending stub shaft supports 26 laterally spaced from each other and having free outer end portions. The stub shaft supports 26 are of a length less than the outwardly extending dimension of a bag opened for loading and greater than the thickness of the bag pack 10 for slidably receiving the bag mounting apertures 20 and mounting the bag pack 10 on the rack 25 (see FIGS. 6, 7, 10, 12, 16 and 20). Each of the stub shaft supports 26 further includes an enlarged portion 27 on the free outer end portions of greater dimensions than the bag mounting apertures 20.

With the above generic features of the bag pack 10 and supporting rack 25 system, the front wall portion 13 and the front section of the gussetted side wall portions 15 having the additional cut 21 therein for effectively enlarging the mounting apertures 20 therein may be easily pulled from the stub shaft supports 26, since these mounting apertures 20 are thereby rendered substantially "front-side-free", to open the outer most bag 11 in the bag pack 10 while retaining the rear wall 14 and the rear section of the gussetted side wall portions 15 of the bag 11 on the stub shaft supports 26 by virtue of the resistance provided against the mounting apertures 20 in the rear wall portion 14 and the rear section of the gussetted side wall portions 15 by the enlarged portions 27 on the free ends of the stub shaft supports 26, so that the opened bag 11 is partially held on the rack 25 in the open position during loading (see FIGS. 6, 7, 10, 12, 16 and 20).

The rack 25 may include a generally horizontally extending bag supporting base 28 and suitable vertical and horizontally extending frame members 29. Also, the bags 11 may be formed from any suitable material including high density polyethylene film.

Figure 11:
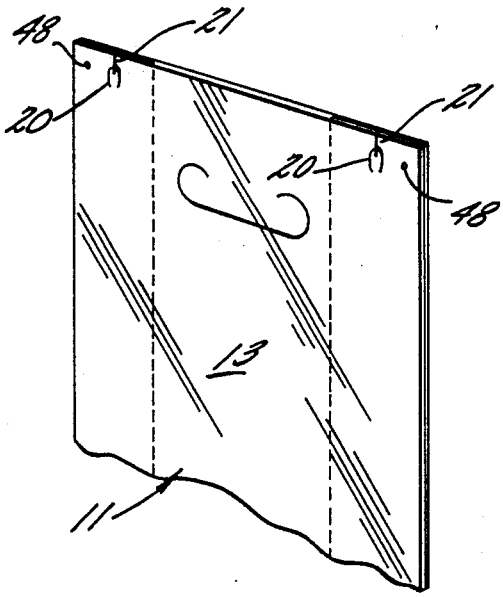
FIG. 11 is a partial perspective view of a third embodiment of a bag utilized in a bag pack constructed in accordance with this invention.
Figure 12:
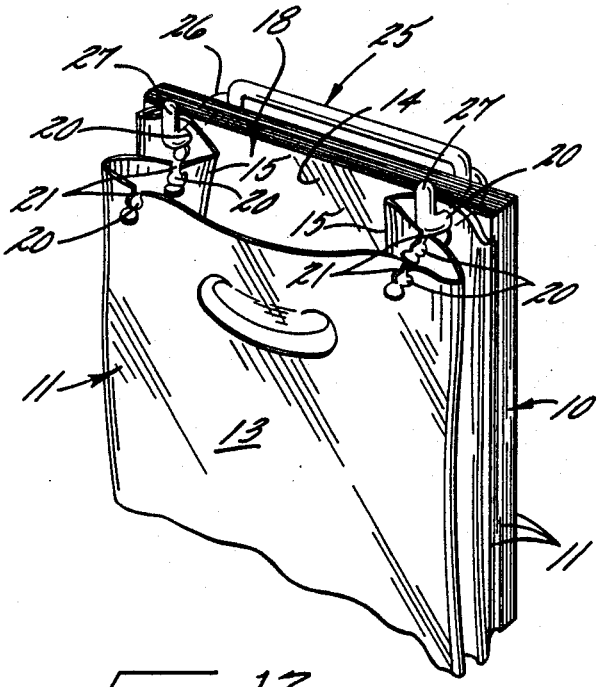
FIG. 12 is a partial perspective view of a bag pack utilizing the bag of FIG. 11 and mounted on a supporting rack.
Figure 13:
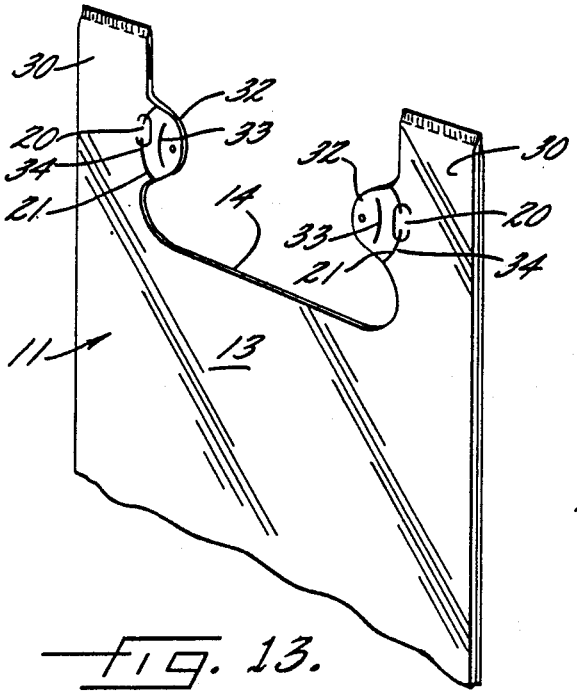
FIG. 13 is a perspective view of a fourth embodiment of a bag utilized in a bag pack constructed in accordance with this invention.
Figure 14:
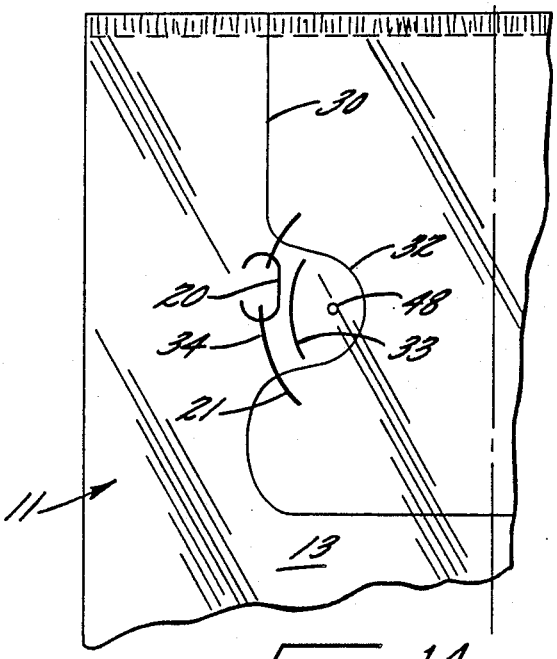
FIG. 14 is a partial schematic view illustrating the cuts made in a tubular blank of material to form the bag of FIG. 13.
Figure 15:
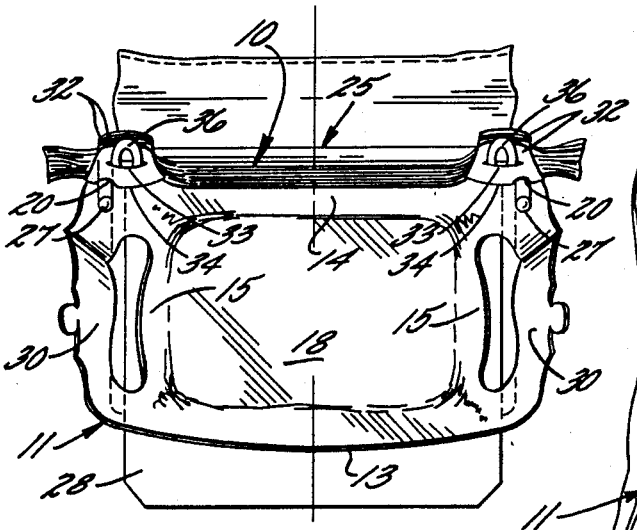
FIG. 15 is a top plan view of a bag pack utilizing the bag of FIG. 13 and mounted on a supporting rack and having the first consecutive bag in an open position for loading.
Figure 16:
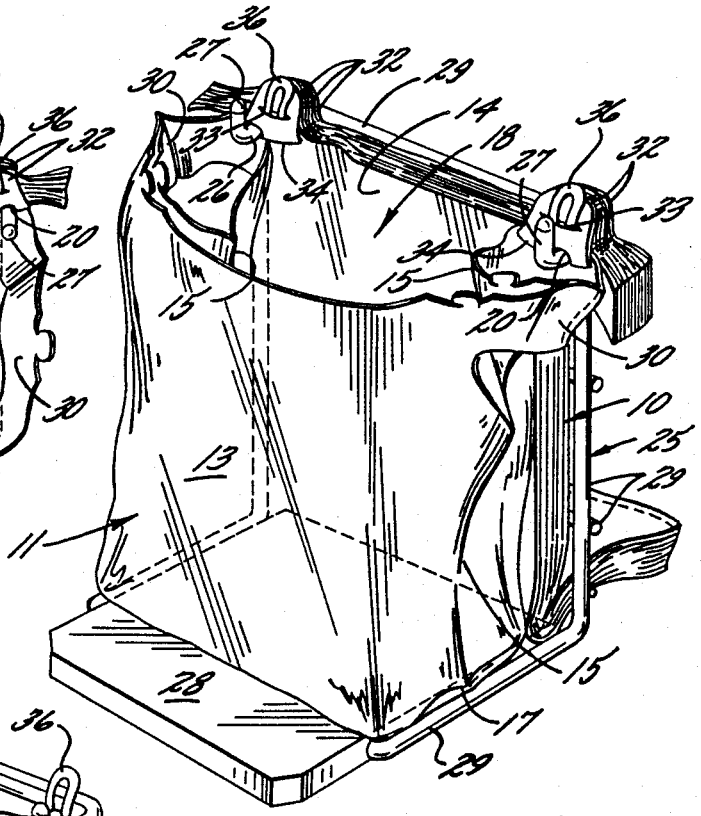
FIG. 16 is a perspective view of the bag pack and supporting rack system of FIG. 15.
Figure 17:
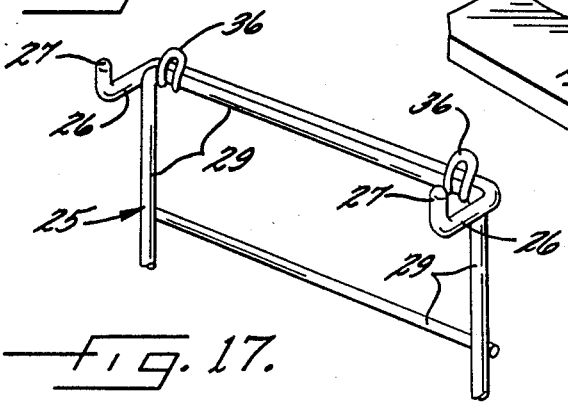
FIG. 17 is a partial perspective view of the supporting rack utilized in the system of FIGS. 15 and 16.
Figure 18:
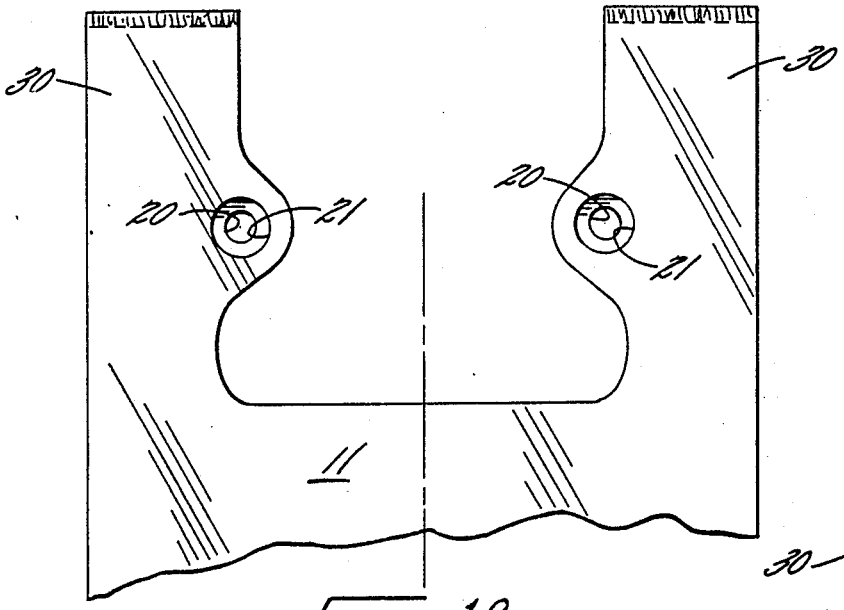
FIG. 18 is a partial front elevational view of a fifth embodiment of a bag utilized in a bag pack constructed in accordance with this invention.
Figure 19:
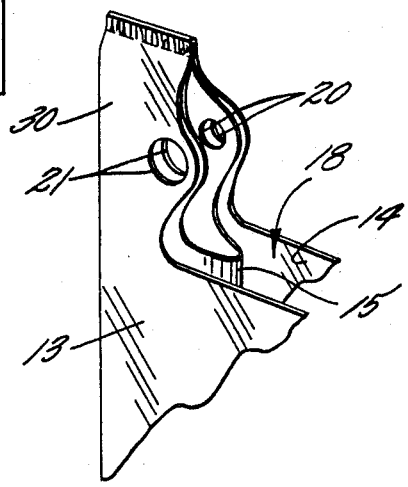
FIG. 19 is a perspective detail of one of the handle portions of the bag of FIG. 18 showing the bag mounting apertures therethrough.
Figure 20:
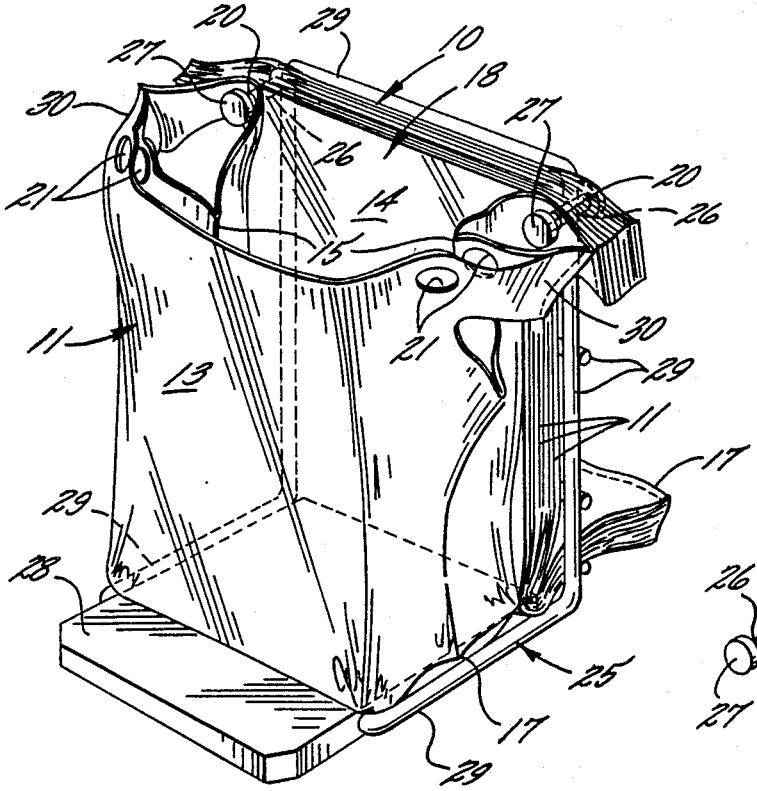
FIG. 20 is a perspective view of a bag pack utilizing the bag of FIG. 18 and mounted on a supporting rack.
Figure 21:
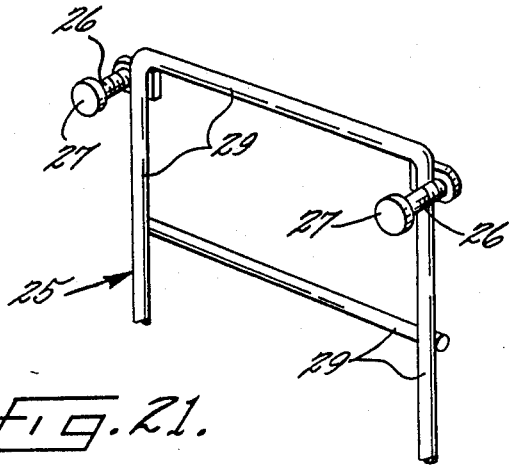
FIG. 21 is a partial perspective view of the supporting rack of the system of FIG. 20.

With respect to the embodiments of FIGS. 1–8, 9–10, 13–17 and 18–21, each of the bags 11 in the bag pack 10 further includes laterally spaced handles 30 integral with the wall portions 13, 14 and 15 and extending upwardly from opposed sides of the mouth portion 18 and having the aligned bag mounting apertures 20 formed through an intermediate area of each of the handles 30. This construction provides the well known T-shirt bag shape. Alternatively, the embodiment of FIGS. 11–12 provides a flat top on the bag 11 in which none of the wall portions 13, 14 or 15 are secured together for providing the open mouth 18. Each of the bags 11 of this embodiment of FIGS. 11–12 may include aligned generally U-shaped cuts through a central area of the front and rear bag walls 13, 14 to from handle openings in the bag for grasping by the user and carrying of the bags 11.

As shown in the embodiments of the easy opening bag pack and supporting rack system illustrated in FIGS. 1–8 and 13–16, each of the bags 11 in the bag pack 10 may further include detachable mounting tabs 32 extending from at least the front and rear wall portions 13, 14 in the vicinity of the mouth portion 18 and including a mounting aperture 33 therein which may be in the form of a cut slit, and means detachably connecting the mounting tabs 32 to the respective wall portions, which may be in the form of a slit 34 leaving a small tearable residue of connecting material on each side thereof, for easy detachment by tearing of the respective wall portions from the mounting tabs 32. In these embodiments, the rack 25 further includes bag mounting tab retaining means 36, which may be in the form of a looped hook suitably, secured to the rack 25 between the stub shaft supports 26 (1) for receiving the mounting apertures 33 in the mounting tabs 32, (2) for cooperating with the stub shaft supports 26 to mount the bag pack 10 on the rack 25 and to support the consecutive opened bags 11 on the rack 25 and (3) for allowing consecutive detachment of at least the front and rear wall portions 13, 14 of each of the bags 11 from the mounting tabs 32 as the bags 11 are opened and then removed from the rack 25 by retaining the mounting tabs 32 on the retaining means 36 as the bag wall portions are torn therefrom.

In the embodiment of FIGS. 1–8, the detachable mounting tabs 32 extend upwardly from each of the front and rear wall portions 13, 14 of the bag 11 at a central area of the mouth portion 18 between the handles 30. In the embodiment of FIGS. 13–17, the detachable mounting tabs 32 extend outwardly from the inside edges of the wall portions 13, 14 and 15 in the handles 30 at an intermediate area of the handles 30. In this embodiment, the additional cut 21 is formed as an extension of the cut 34 so that the mounting tabs 32 on the front wall portion 13 and the front section of the gussetted side wall portions 15 are in effect "front-side-free".

In the embodiments of the system illustrated in FIGS. 1–8, 9–10, 11–12 and 13–17, the additional cut means 21 for effectively enlarging the bag mounting apertures 20 in the front wall portion 13 and the front section of the gussetted side wall portions 15 comprise a generally linear cut through the wall portions extending from the apertures 20 to a free edge of the wall portions to effectively open the apertures and render these walls portions "front-side-free". Also, the bag mounting apertures 20 are formed by a cut which does not completely close and thereby leaves flap portions in the apertures. In the embodiment of the system illustrated in FIGS. 18–21, the additional cut means 21 for effectively enlarging the bag mounting apertures 20 in the front wall portions 13 and the front sections of the gussetted side wall portions I5 comprise a cut which is generally concentric with, of greater dimensions than and extends around such apertures 20 in these wall portions to enlarge such apertures 20 to a size larger than the enlarged portions 27 on the free outer end portions of the stub shaft supports 26.

In the embodiments of the system illustrated in FIGS. 1–8, 9–10, 11–12 and 13–17, the enlarged portion 27 on the free outer end portions of the stub shaft supports 26 of the rack 25 comprise an upwardly extending section of the stub shaft supports 26 of generally the same cross-sectional configuration as the stub shaft supports 26 to define generally a hook and which allows easy removal of a filled bag 11 by lifting to allow the bag supporting apertures 20 in the rear section of the gussetted side wall portions 15 and the rear wall portion 14 to slide around and off of the hook portions 27. In the embodiment of the system illustrated in FIGS. 18–21, the enlarged portion 27 on the free outer end portions of the stub shaft supports 26 comprises a generally circular flange of similar configuration but smaller than the enlarged bag mounting apertures 20 in the front wall portion 13 and the front section of the gussetted side wall portions 15. The filled bag is removed from the rack 25 in this system by simply tearing the bag material at the smaller bag mounting apertures 20 in the rear section of the gussetted wall portions 15 and the rear wall portion i4.

Figure 1:
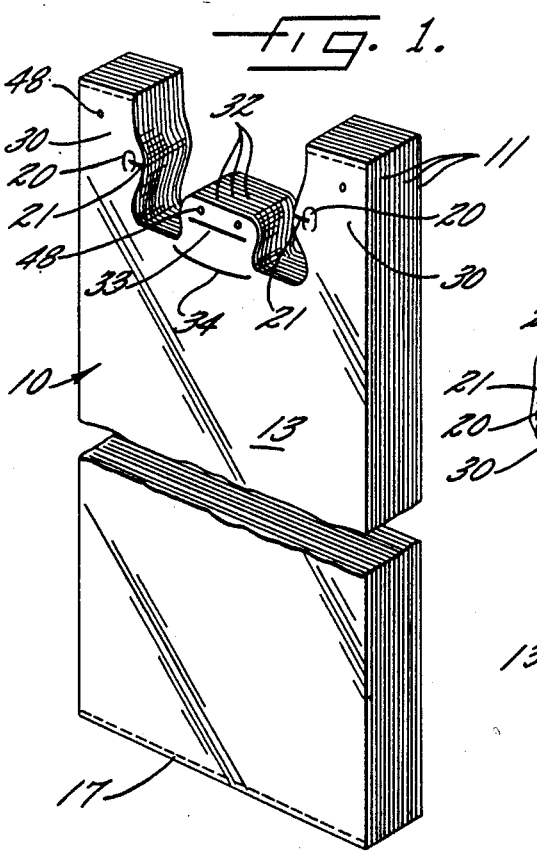
FIG. 1 is a perspective view, broken away, of a first embodiment of a bag pack constructed in accordance with this invention.
Figure 2:
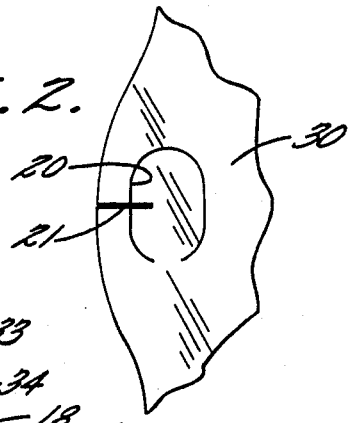
FIG. 2 is an enlarged detail in elevation of the bag mounting apertures through the front wall portion of a bag of the bag pack of FIG. 1 with the additional cut for effectively enlarging such aperture.
Figure 3:
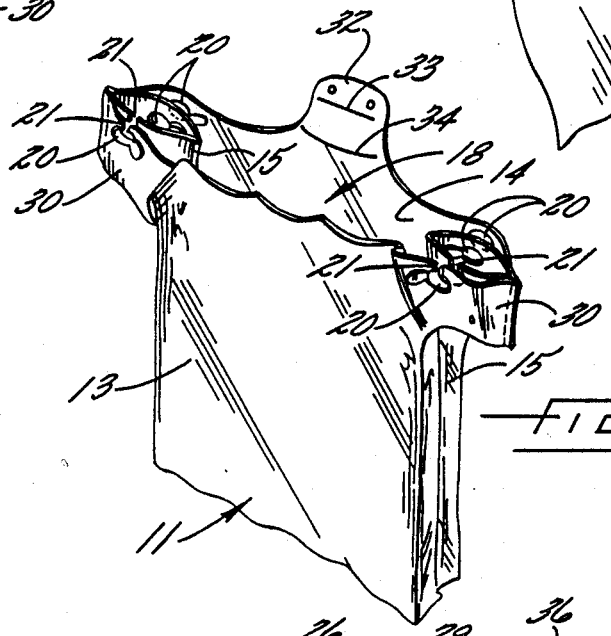
FIG. 3 is a partial perspective view of one of the bags of the bag pack of FIG. 1 which has been partially opened.
Figure 4:
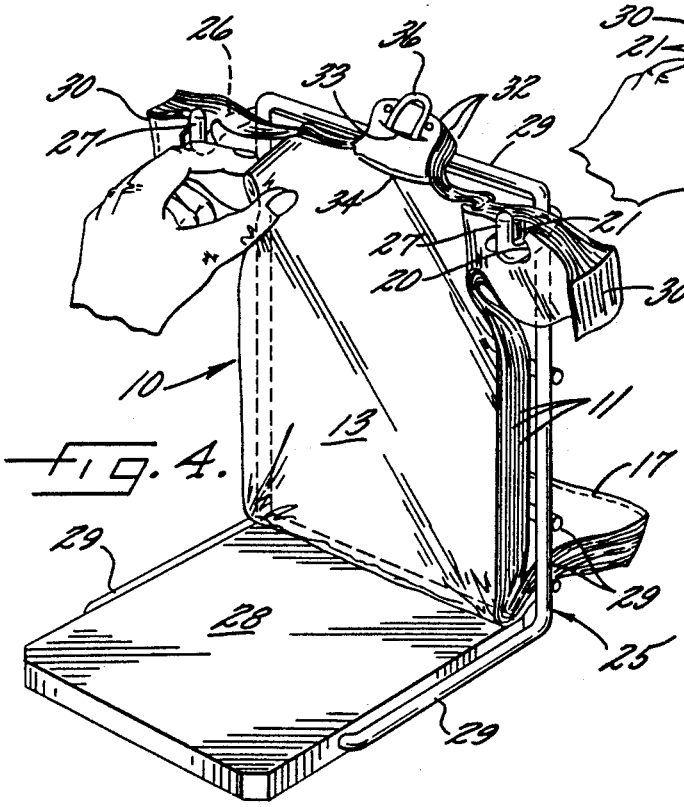
FIG. 4 is a perspective view of the bag pack of FIG. 1 as mounted on a rack.
Figure 5:
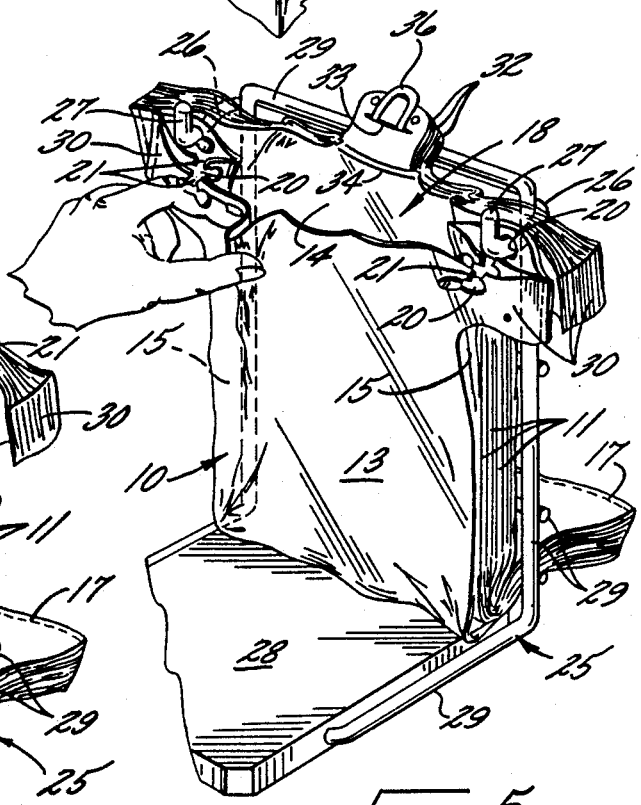
FIG. 5 is a perspective view of the bag pack and rack system of FIG. 4 with the first consecutive bag of the bag pack being opened.
Figure 6:
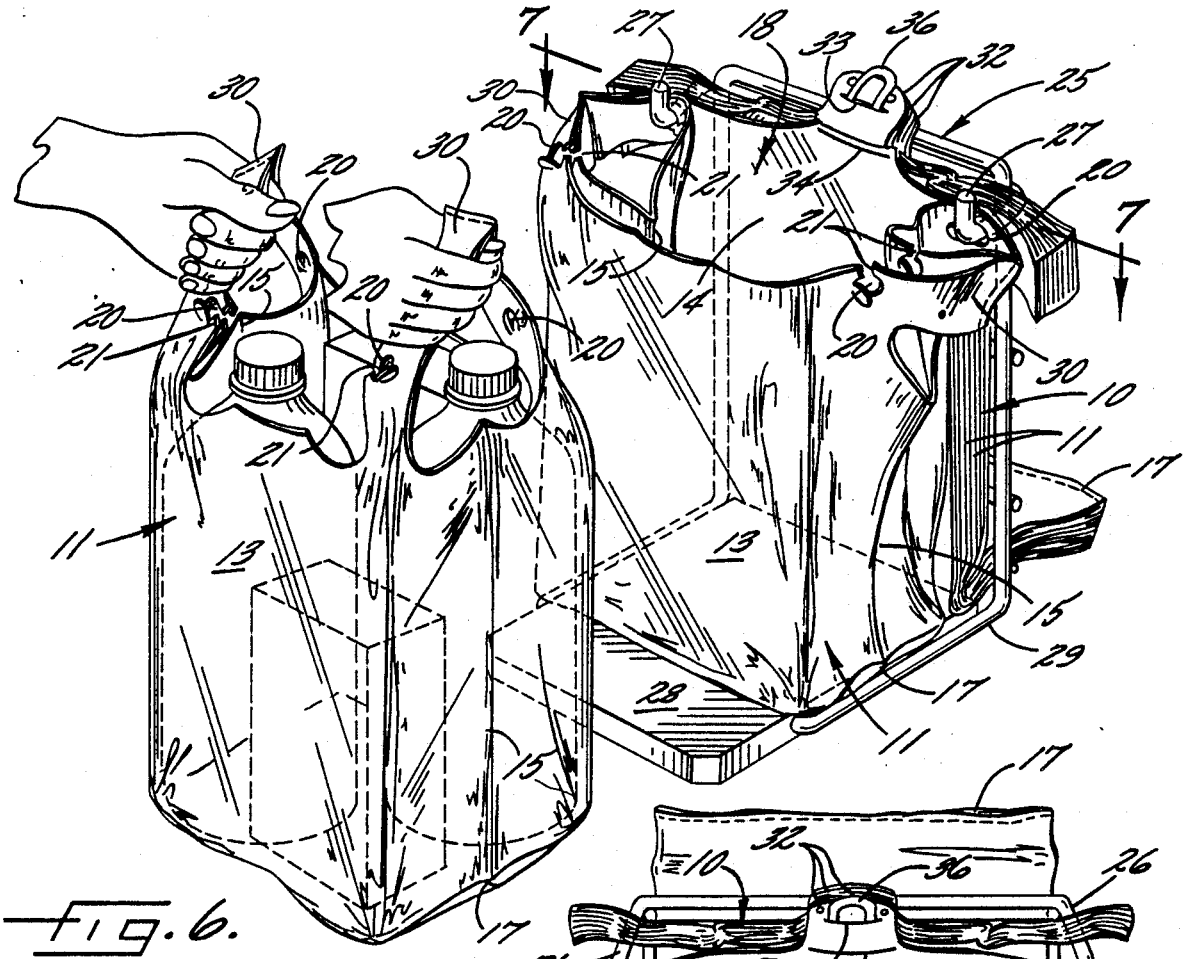
FIG. 6 is a perspective view of the bag pack and rack system of FIG. 4 showing a filled bag removed from the rack and the next consecutive bag open for filling.
Figure 7:
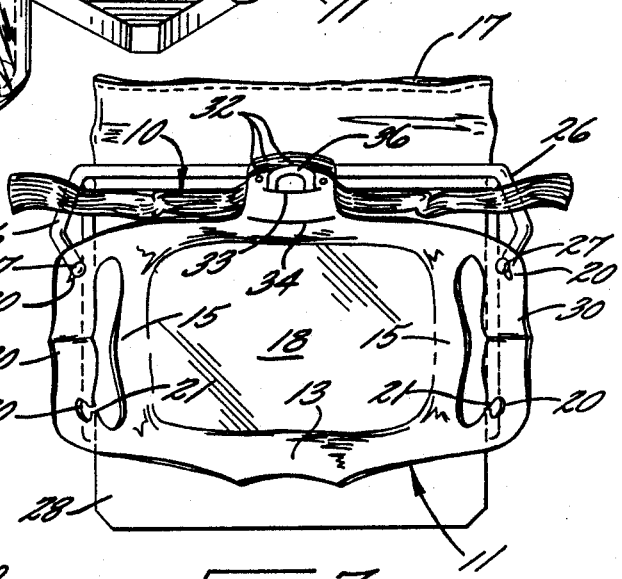
FIG. 7 is a top plan view, taken generally along the line 7—7, of the bag pack and supporting rack system of FIG. 6.
Figure 8:
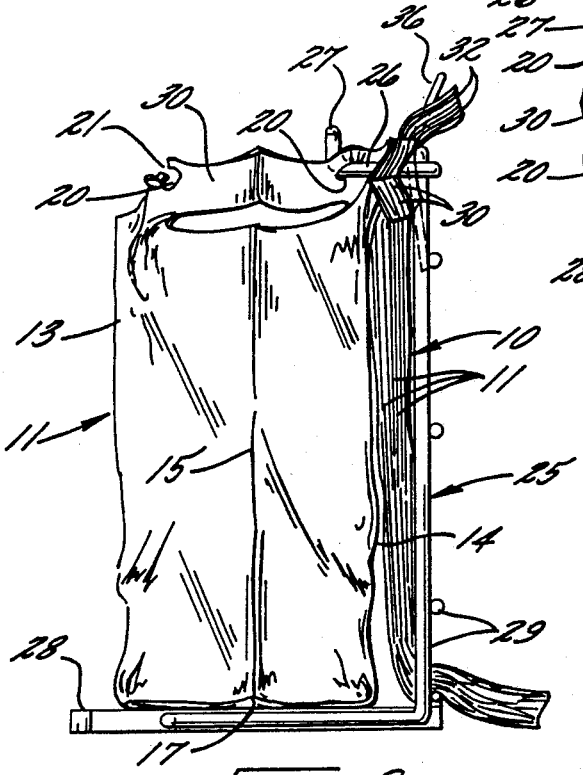
FIG. 8 is a side elevational view of the bag pack and rack system of FIG. 6.
Figure 9:
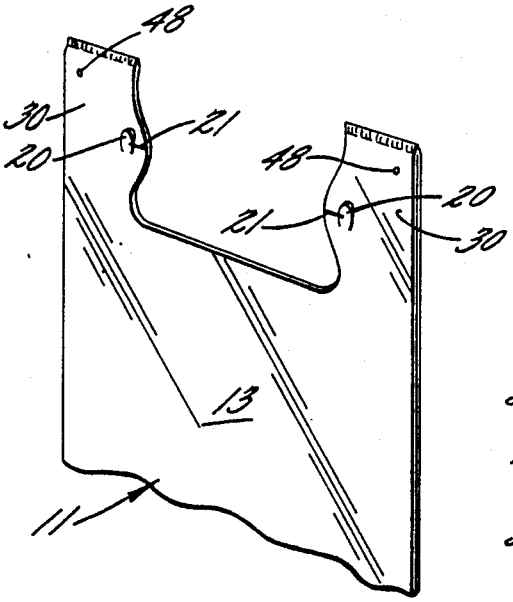
FIG. 9 is a perspective view of a second embodiment of a bag utilized in a bag pack constructed in accordance with this invention.
Figure 10:
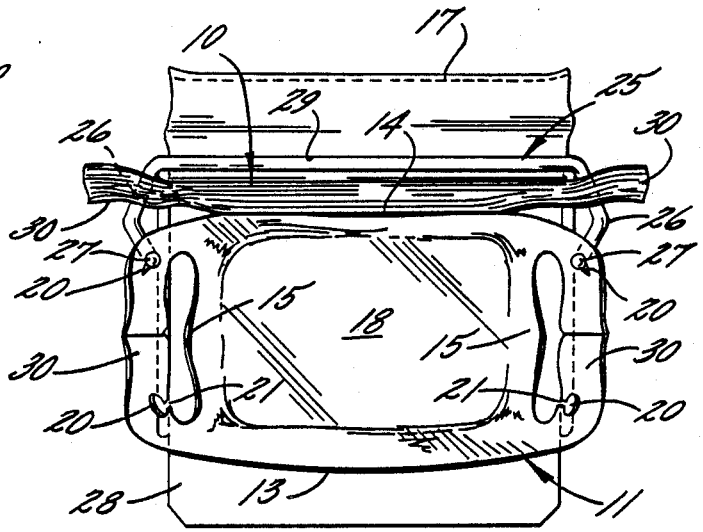
FIG. 10, is a top plan view of the embodiment of a bag pack utilizing the bag of FIG. 9 and mounted on a supporting rack and having the first consecutive bag in an open position for loading.

The rack 25 of any of the embodiments of the system of this invention may include stub shaft supports 26 which are generally angled in opposed outwardly extending directions to provide middle sections therein which are laterally spaced apart from each other a greater distance than the remaining sections of the length of the stub shaft supports 26 to provide additional resistance to movement of the bag mounting apertures 20 in the rear wall portion 14 and the rear section of the gussetted side wall portions 15 of the bag 11 to retain these wall portions on the rack 25 while allowing the bag mounting apertures 20 having the additional cut means 21 therein for effectively enlarging such apertures 20 to easily move thereover to open the bag (as shown in FIG. 10).

Referring now to FIGS. 2–24, a method of fabricating easy opening thermoplastic grocery or retail product bag packs 10 of the construction described above, particularly that of the first embodiment illustrated in FIGS. 1–8, is shown therein. This method includes the following steps. A generally flat side gussetted continuous tube of thermoplastic film 40 is fed, such as by suitable driven feed rolls 41, 42, in a generally linear direction and along flat plates 43 extending into the side gusset folds to separate front and rear sections of the gusset folds. The top layer and front section of the gusset fold is cut against the flat plates 43 in a desired configuration at spaced intervals as the tube is being fed in the linear direction, such as by a reciprocating cutter 44, to form the additional cut portions 21 which will effectively enlarge bag mounting apertures 20 in the bags 11 being fabricated. Thereafter, the continuous flat tube 40 is transversely cut at spaced intervals as the tube is being fed in the linear direction and between the cuts 21 formed by the preceding cutting step, such as by a reciprocating cutting device 45 to form individual bags from the tube. This cutting step includes sealing at least every other transverse cut to form the closed bottoms on the bags. This may be accomplished by the use of a device for simultaneously cutting and heat sealing if the bags are to be cut and heat sealed at each transverse cut or by a separate reciprocating sealing device (not shown) which would operate for every other transverse cut. Lastly, the tag mounting apertures 20 are cut through all of the layers on opposed sides of the bag and in communication with the additional cut 21 in the top layer and front section of the gusset folds at a desired time in the bag fabricating method.

As shown in FIGS. 22 and 23 when fabricating T-shirt shaped bags, the individual bags are stacked by a suitable mechanism following simultaneous transverse cutting and heat sealing and desired portions are then cut from the tops of the stacked bags to produce the desired T-shirt configuration at the tops of the bags, while also cutting the bag mounting apertures 20 through all of the layers in the handles 30 and in communication with the additional cut 21 previously formed in the top layer and front section of the gusset folds in the handles 30, such as by a suitable reciprocating die cutting mechanism 47. If desired, the stacked bags 11 may be cold staked or hot staked at 48 by a reciprocating staking mechanism 49 to detachably hold the bags in alignment while allowing easy disconnection of the bags.

Thus, there has been disclosed and described five preferred embodiments of a bag pack, preferably of the thermoplastic grocery or retail product type, and supporting rack system providing for easy opening of consecutive bags from the pack and supporting of the opened bag on the rack during loading of the bag for ultimate removal of a loaded bag which is user friendly and ergonomically sound. It is to be understood that other embodiments of bag packs and/or rack systems could be constructed utilizing one or more of the novel features of this invention without departing from the scope of this invention. Additionally, a viable method of fabricating such bags has teen disclosed and described which eliminates problems heretofore presented in such fabricating methods.

In the drawings and specification set forth above, specific terms are employed and they are used in a generic and descriptive sense only and not for purposes of limitation, the scope of the invention is defined in the following claims.

What is claimed is:

1. An easy opening bag pack and supporting rack system comprising:

a bag pack including a plurality of stacked thermoplastic bags, each of said bags comprising integrally connected front and rear wall portions and gussetted side wall portions along respective sides of the front and rear wall portions, with each gusseted side wall portion comprising a front section adjacent said front wall portion and a rear section adjacent said rear wall portion, all of said wall portions being secured together at the bottoms thereof to define a closed bottom on said bag, at least a part of said front and rear bag wall portions being open at the tops thereof to define a mouth portion on said bag, aligned bag mounting apertures cut through all of said wall portions on opposed sides of said bag near the top thereof, and additional cut means in said front wall portion and the front section of said gussetted side wall portions and in communication with said apertures therein for effectively enlarging said apertures; and a rack for mounting said bag pack in a generally vertically suspended position, said rack including two outwardly extending stub shaft support means laterally spaced from each and having free outer end portions, said stub shaft support means being of a length less than the outwardly extending dimension of a bag open for loading and greater than the thickness of said bag pack for slidably receiving said bag mounting apertures and mounting said bag pack on said rack and having an enlarged portion on said free outer end portions of greater dimension than said bag mounting apertures;

whereby, said front wall portion and the front section of said gussetted side wall portions having said additional cut means for effectively enlarging said apertures therein may be easily pulled from said stub shaft support means to open the outermost bag in said bag pack while retaining said rear wall and the rear section of said gussetted side wall portions of said bag on said stub shaft support means by virtue of the resistance provided against said apertures therein by said enlarged portion on the free ends of said support means so that said opened bag is partially held on said rack in the open position during loading.

2. A system, as set forth in claim 1, in which each of said bags in said bag pack further includes laterally spaced handles integral with said wall portions and extending upwardly from opposed sides of said mouth portion and having said aligned bag mounting apertures formed through an intermediate area of each of said handles.

3. A system, as set forth in claim 1, in which each of said bags in said bag pack further includes aligned generally U-shaped cuts through a central area of said front and rear wall portions below said mouth to form handle openings in said bag.

4. A system, as set forth in claim 2, in which each of said bags in said bag pack further include detachable mounting tab means extending from at least said front and rear wall portions in the vicinity of said mouth portion and including a mounting aperture therein and means detachably connecting said mounting tab means to said respective wall portions for easy detachment by tearing of said respective wall portions from said mounting tab means; and in which said rack further includes bag mounting tab retaining means positioned generally between said stub shaft support means (1) for receiving said mounting apertures in said mounting tab means, (2) for cooperating with said stub shaft support means to mount said bag pack on said rack and to support the consecutive opened bags on said rack and (3) for allowing consecutive detachment of said front and rear wall portions of each of said bags from said mounting tab means as said bags are opened and then removed from said rack by retaining said mounting tab means on said retaining means.

5. A system, as set forth in claim 4, in which said detachable mounting tab means comprises aligned detachable mounting tabs extending upwardly from each of said front and rear wall portions at a central area of said mouth portion between said handles.

6. A system, as set forth in claim 4, in which said detachable mounting tab means comprise aligned detachable mounting tabs extending outwardly from the inside edges of said wall portions in said handles at an intermediate area of said handles.

7. A system, as set forth in claim 1, 2, 3, 4, 5 or 6, in which said additional cut means for effectively enlarging said bag mounting apertures in said front wall portion and the front section of said gussetted side wall portions comprises a generally linear cut through said wall portions extending from said apertures to a free edge of said wall portions.

8. A system, as set forth in claim 1, 2, 3, 4, 5 or 6, in which said additional cut means for effectively enlarging said bag mounting apertures in said front wall portion and the front section of said gussetted side wall portions comprises a cut which is generally concentric with, of greater dimensions than and extends around said apertures.

9. A system, as set forth in claim 1, 2, 3, 4, 5 or 6, in which said enlarged portion on said free outer end portions of said stub shaft support means comprises an upwardly extending section of said stub shaft support means of generally the same crosssectional configuration as said stub shaft support means to define generally a hook.

10. A system, as set forth in claim 1, 2, 3, 4, 5 or 6, in which said enlarged portion on said free outer end portions of said stub shaft support means comprises a generally circular flange member.

11. A system, as set forth in claim 1, 2, 3, 4, 5 or 6, in which said additional cut means for effectively enlarging said bag mounting apertures in said front wall portion and the front section of said gussetted side wall portions comprises a generally linear cut through said wall portions extending from said apertures to a free edge of said wall portions; and in which said enlarged portion on said free outer end portions of said stub shaft support means comprises an upwardly extending section of said stub shaft support means of generally the same cross-sectional configuration as said stub shaft support means to define generally a hook.

12. A system, as set forth in claim 1, 2, 3, 4, 5 or 6, in which said additional cut means for effectively enlarging said bag mounting apertures in said front wall portion and the front section of said gussetted side wall portions comprises a cut which is generally concentric with, of greater dimensions than and extends around said apertures; and in which said enlarged portion on said free outer end portions of said stub shaft support means comprises a generally circular flange member.

13. A pack of easy opening bags, adapted to be mounted in a generally vertical suspended position on a rack which includes two outwardly extending stub shaft support means laterally spaced from each other and having enlarged free outer end portions and being of a length less than the outwardly extending dimension of a bag opened for loading and greater than the thickness of said bag pack, said bag pack comprising a plurality of stacked bags in which each of said bags comprises:

integrally connected front and rear wall portions and gussetted side wall portions along respective sides of the front and rear wall portions, with each gusseted side wall portion comprising a front section adjacent said front wall portion and a rear section adjacent said rear wall portion, all of said wall portions being secured together at the bottoms thereof to define a closed bottom on said bag and at least partially open at the tops thereof to define a mouth portion on said bag; and aligned bag mounting apertures cut through all of said wall portions on opposed sides of said bag near the top thereof for being adapted to be slidably positioned on the stub shaft support means of the rack for mounting said bag pack thereon and including an additional generally linear cut through said front wall portion and the front section of said gussetted side wall portions extending from said mounting apertures therein to a free edge of said wall portions for effectively enlarging said apertures in said front wall portion and the front section of said gussetted side wall portions;

so that, said front wall portion and the front section of said gussetted side wall portions are adapted to be easily pulled from the stub shaft support means when said bag pack is mounted on the rack to open the outermost bag in said bag pack while retaining the rear wall and rear section of said gussetted side wall portions of said bag on the stub shaft support means by virtue of the resistance provided against said apertures therein by the enlarged portion on the free ends of the stub shaft support means so that the opened bag is partially held on the rack in an open position during loading.

14. A pack of easy opening bags, adapted to be mounted in a generally vertical suspended position on a rack which includes two outwardly extending stub shaft support means laterally spaced from each other and having enlarged free outer end portions and being of a length less than the outwardly extending dimension of a bag opened for loading and greater than the thickness of said bag pack, said bag pack comprising a plurality of stacked bags in which each of said bags comprises:

integrally connected front and rear wall portions and gussetted side wall portions along respective sides of the front and rear wall portions, with each gusseted side wall portion comprising a front section adjacent said front wall portion and a rear section adjacent said rear wall portion, all of said wall portions being secured together at the bottoms thereof to define a closed bottom on said bag and at least partially being opened at the tops thereof to define a mouth portion on said bag; and aligned bag mounting apertures cut through all of said wall portions on opposed sides of said bag near the top thereof for being adapted to be slidably positioned on the stub shaft support means of the rack for mounting said bag pack thereon and including an additional cut through said front wall portion and the front section of said gussetted side wall portions and extending generally concentrically around said mounting apertures therein for enlarging said apertures in said front wall portion and the front section of said gussetted side wall portions;

so that, said front wall portion and the front section of said gussetted side wall portions are adapted to be easily pulled from the stub shaft support means when said bag pack is mounted on the rack to open the outermost bag in said bag pack while retaining the rear wall and rear section of said gussetted side wall portions of said bag on the stub shaft support means by virtue of the resistance provided against said apertures therein by the enlarged portion on the free ends of the stub shaft support means so that the opened bag is partially held on the rack in an open position during loading.

15. A pack of easy opening bags, as set forth in claim 13 or 14, in which each of said bags in said bag pack further includes laterally spaced handles integral with said wall portions and extending upwardly from opposed sides of said mouth portion and having said aligned bag mounting apertures formed through an intermediate area of each of said handles.

16. A pack of easy opening bags, as set forth in claim 13 or 14, in which each of said bags in said bag pack further includes aligned generally U-shaped cuts through a central area of said front and rear wall portions below said mouth to form handle openings in said bag.

17. A pack of easy opening bags, as set forth in Claim 15, in which each of said bags in said bag pack further include detachable mounting tab means extending from at least said front and rear wall portions in the vicinity of said mouth portion and including a mounting aperture therein and means detachably connecting said mounting tab means to said respective wall portions for easy detachment by tearing of said respective wall portions from said mounting tab means and being adapted to be mounted on a tab retaining means positioned generally between the stub shaft support means on the rack for cooperating with said stub shaft support means to mount said bag pack on said rack and to support the consecutive opened bags on said rack and for allowing consecutive detachment of said front and rear wall portions of each of said bags from said mounting tab means as said bags are opened and then removed from said rack by retaining said mounting tab means on said retaining means.

18. A pack of easy opening bags, as set forth in claim 17, in which said detachable mounting tab means comprises aligned detachable mounting tabs extending upwardly from each of said front and rear wall portions at a central area of said mouth portion between said handles.

19. A pack of easy opening bags, as set forth in claim 17, in which said detachable mounting tab means comprise aligned detachable mounting tabs extending outwardly from the inside edges of said wall portions in said handles at an intermediate area of said handles.

* * * * *

UNITED STATES PATENT AND TRADEMARK OFFICE

CERTIFICATE OF CORRECTION

PATENT NO. : 4,981,216

DATED : January 1, 1991

INVENTOR(S) : Harry B. Wilfong, Jr.

It is certified that error appears in the above-identified patent and that said Letters Patent is hereby corrected as shown below:

Column 8, line 65, "2-24" should be -- 22-24 --.

Column 9, line 25, "tag" should be -- bag --.

Column 9, line 58, "teen" should be -- been --.

Signed and Sealed this

Sixteenth Day of June, 1992

*Attest:*

DOUGLAS B. COMER

*Attesting Officer*

*Acting Commissioner of Patents and Trademarks*